US009222183B2

(12) United States Patent
D'Astolfo, Jr.

(10) Patent No.: US 9,222,183 B2
(45) Date of Patent: Dec. 29, 2015

(54) INERT ELECTRODES WITH LOW VOLTAGE DROP AND METHODS OF MAKING THE SAME

(71) Applicant: ALCOA INC., Pittsburgh, PA (US)

(72) Inventor: Leroy E. D'Astolfo, Jr., Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 155 days.

(21) Appl. No.: 13/954,019

(22) Filed: Jul. 30, 2013

(65) Prior Publication Data

US 2014/0034507 A1 Feb. 6, 2014

Related U.S. Application Data

(60) Provisional application No. 61/678,178, filed on Aug. 1, 2012, provisional application No. 61/739,373, filed on Dec. 19, 2012, provisional application No. 61/774,210, filed on Mar. 7, 2013.

(51) Int. Cl.

| | |
|---|---|
| ***C25C 3/12*** | (2006.01) |
| ***C25C 7/02*** | (2006.01) |
| ***C25C 3/16*** | (2006.01) |

(52) U.S. Cl.

CPC ... *C25C 3/12* (2013.01); *C25C 3/16* (2013.01); *C25C 7/025* (2013.01)

(58) Field of Classification Search

None

See application file for complete search history.

(56) References Cited

U.S. PATENT DOCUMENTS

| | | | | |
|---|---|---|---|---|
| 4,450,061 | A * | 5/1984 | Rolf | 204/288.2 |
| 4,468,299 | A * | 8/1984 | Byrne et al. | 205/369 |
| 4,966,674 | A | 10/1990 | Bannochie et al. | |
| 6,248,227 | B1 * | 6/2001 | de Nora et al. | 205/230 |
| 6,436,274 | B2 * | 8/2002 | De Nora et al. | 205/384 |
| 6,805,777 | B1 | 10/2004 | D'Astolfo, Jr. | |
| 6,821,312 | B2 | 11/2004 | Ray et al. | |
| 6,855,234 | B2 | 2/2005 | D'Astolfo, Jr. | |
| 7,014,881 | B2 | 3/2006 | Liu et al. | |
| 7,235,161 | B2 | 6/2007 | DiMilia et al. | |
| 7,316,577 | B2 | 1/2008 | Latvaitis et al. | |
| 7,323,134 | B2 | 1/2008 | Latvaitis et al. | |
| 7,452,450 | B2 | 11/2008 | Julsrud et al. | |
| 7,799,187 | B2 | 9/2010 | DiMilia et al. | |
| 2001/0035344 | A1 * | 11/2001 | D'Astolfo et al. | 204/243.1 |
| 2004/0074625 | A1 * | 4/2004 | Musat et al. | 164/138 |
| 2004/0198103 | A1 * | 10/2004 | Latvaitis et al. | 439/887 |

(Continued)

FOREIGN PATENT DOCUMENTS

| | | |
|---|---|---|
| CN | 1614097 | 5/2005 |
| CN | 102206837 | 10/2011 |

(Continued)

OTHER PUBLICATIONS

International Search Report and Written Opinion of the International Searching Authority dated Dec. 11, 2013 from related PCT International Application No. PCT/US2013/052726.

(Continued)

*Primary Examiner* — Harry D Wilkins, III

(74) *Attorney, Agent, or Firm* — Greenberg Traurig, LLP

(57) ABSTRACT

An electrolytic cell anode, including an encasing conductive material configured to encase a dense conductive material and define the electrolytic cell anode, wherein the dense conductive material has an electrical conductivity greater than that of the encasing conductive material.

31 Claims, 5 Drawing Sheets

(56) References Cited

U.S. PATENT DOCUMENTS

| | | | | |
|---|---|---|---|---|
| 2004/0231979 | A1* | 11/2004 | De Nora | 204/289 |
| 2005/0199508 | A1* | 9/2005 | D'Astolfo et al. | 205/380 |

FOREIGN PATENT DOCUMENTS

| | | | | |
|---|---|---|---|---|
| GB | 2135335 | | 8/1984 | |
| WO | WO 00/06800 | * | 2/2000 | C25C 3/12 |
| WO | 02/083992 | | 10/2002 | |

OTHER PUBLICATIONS

Chinese Search Report dated Jun. 30, 2015, 2 pp., from related Chinese Application No. 201310330132.6.

* cited by examiner

INERT ELECTRODES WITH LOW VOLTAGE DROP AND METHODS OF MAKING THE SAME

CROSS-REFERENCE TO RELATED APPLICATIONS

This application claims priority to U.S. Provisional Application No. 61/678,178, filed on Aug. 1, 2012, U.S. Provisional Application No. 61/739,373, filed on Dec. 19, 2012, and U.S. Provisional Application No. 61/774,210, filed on Mar. 7, 2013. The disclosure of U.S. Provisional Application Nos. 61/678,178, 61/739,373, and 61/774,210 are hereby incorporated by reference in their entirety for all purposes.

U.S. GOVERNMENT RIGHTS

N/A

COPYRIGHT NOTIFICATION

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

BACKGROUND OF THE INVENTION

1. Field of the Invention

The present invention relates to electrolytic cell electrodes, and in particular, to an electrolytic cell anode with a low voltage drop.

2. Description of the Related Art

Electrolysis of dissolved alumina in molten cryolite is the major industrial process for the production of aluminum metal. In an electrolytic cell, the passage of an electrical current between an anode and a cathode in the molten cryolite causes aluminum metal to be deposited at the cathode as a precipitate. The production rate for the aluminum metal is proportional to the electric current used. Accordingly, maintaining a low voltage drop across the anodes supplying the electrical current improves an energy efficiency and overall performance of the electrolytic cell.

SUMMARY OF THE INVENTION

The present invention relates to electrolytic cell electrodes, and in particular, to an electrolytic cell anode with a low voltage drop.

Additional goals and advantages of the present invention will become more evident in the description of the figures, the detailed description of the invention, and the claims.

The foregoing and/or other aspects and utilities of the present invention may be achieved by providing an electrolytic cell anode, including a dense conductive material, and an encasing conductive material configured to encase the dense conductive material and define the electrolytic cell anode, wherein the dense conductive material has an electrical conductivity greater than that of the encasing conductive material.

In another embodiment, the dense conductive material has an electrical conductivity of at least about 1000 S/cm.

In another embodiment, the encasing conductive material has an electrical conductivity of between about 150 S/cm and 200 S/cm.

In another embodiment, the dense conductive material has an electrical conductivity at least 5 times higher than the encasing material.

In another embodiment, the encasing conductive material includes a metal oxide.

In another embodiment, the encasing conductive material includes at least one of an iron oxide, nickel oxide, zinc oxide, copper oxide, tin oxide, and combinations thereof.

In another embodiment, the encasing conductive material further includes an iron oxide.

In another embodiment, the encasing conductive material includes at least one of $Fe_3O_4$, $Fe_2O_3$, and FeO.

In another embodiment, the dense conductive material includes a metal oxide.

In another embodiment, the dense conductive material further includes a metal,

In another embodiment, the dense conductive material includes a metal oxide portion and a metallic portion.

In another embodiment, the dense conductive material includes the same metal oxide as the encasing material.

In another embodiment, the dense conductive material includes at least one of $Fe_3O_4$, $Fe_2O_3$, and FeO.

In another embodiment, the metallic portion includes metal particles within the metal oxide.

In another embodiment, the dense conductive material includes copper.

In another embodiment, the metallic portion gives the dense conductive material a higher electrical conductivity than the encasing conductive material when the dense conductive material and the encasing conductive material comprise the same metal oxide.

In another embodiment, the dense conductive material and the encasing conductive material are integrally formed into the electrolytic cell anode.

In another embodiment, the electrolytic cell anode is substantially non-consumable and dimensionally stable.

In another embodiment, the electrolytic cell anode is substantially an inert anode.

In another embodiment, the electrolytic cell anode is configured to remain stable in a molten bath of an aluminum electrolytic cell at a temperature of at least about 750° C.

In another embodiment, the electrolytic cell anode is configured to remain substantially non-consumable and dimensionally stable in a molten bath of an aluminum electrolytic cell at a temperature of at least about 750° C.

In another embodiment, the electrolytic cell anode is configured to stable in a molten bath of an aluminum electrolytic cell at a temperature of at most about 900° C.

In another embodiment, the electrolytic cell anode is configured to remain substantially non-consumable and dimensionally stable in a molten bath of an aluminum electrolytic cell at a temperature of between about 750° C. and 900° C.

In another embodiment, the dense conductive material includes between about 10% and 50% of the electrolytic cell anode.

The foregoing and/or other aspects and utilities of the present invention may also be achieved by providing an anode assembly, including an electrolytic cell anode having a dense conductive material, and an encasing conductive material configured to encase the dense conductive material and define the electrolytic cell anode, wherein the dense conductive material has an electrical conductivity greater than that of the encasing conductive material., and an electrical connector configured to pass an electrical current between the electrolytic cell anode and a cathode of an electrolytic cell.

In another embodiment, the electrical connector does not directly contact the dense conductive material of the electrolytic cell anode.

In another embodiment, the electrical connector couples to the encasing material of the electrolytic cell anode, and wherein the encasing material is configured to encased the dense conductive material of the electrolytic cell anode such that the electrical connector does not directly contact the dense conductive material.

In another embodiment, the anode assembly further includes an electrical contacting material to facilitate the electrical connection between the electrical contact and the electrolytic cell anode.

In another embodiment, the electrical contacting material includes a metal.

In another embodiment, the electrical contacting material includes at least one of a metal paint, a metal foam, metal shot, and combinations thereof.

In another embodiment, the anode assembly is configured for electrolytic aluminum production.

The foregoing and/or other aspects and utilities of the present invention may also be achieved by providing a method including passing an electrical current between an anode and a cathode of an electrolytic reaction cell, wherein the anode includes an anode assembly, including an electrolytic cell anode having a dense conductive material, and an encasing conductive material configured to encase the dense conductive material and define the electrolytic cell anode, wherein the dense conductive material has an electrical conductivity greater than that of the encasing conductive material., and an electrical connector configured to pass an electrical current between the electrolytic cell anode and a cathode of an electrolytic cell.

In another embodiment, the passing of the electrical current includes (i) first passing the electrical current from the electrical connector through a first section of the encasing conductive material of the electrolytic cell anode, wherein the first section is proximal to the electrical connector, (ii) second passing a portion of the current from the first section of the outer portion of the inert electrode into the dense conductive material encased within the electrolytic cell anode, and (iii) third passing a portion of the current from the dense conductive material through to a second section of the encasing conductive material, wherein the second section is proximal to the cathode of the electrolytic bath.

In another embodiment, while the current passes throughout the electrolytic cell anode, a majority of the current passes through the dense conductive material as the electrical current load is balanced.

BRIEF DESCRIPTION OF THE DRAWINGS

These and/or other aspects and advantages of the present invention will become apparent and more readily appreciated from the following description of the various embodiments, taken in conjunction with the accompanying drawings of which.

Figure 2:
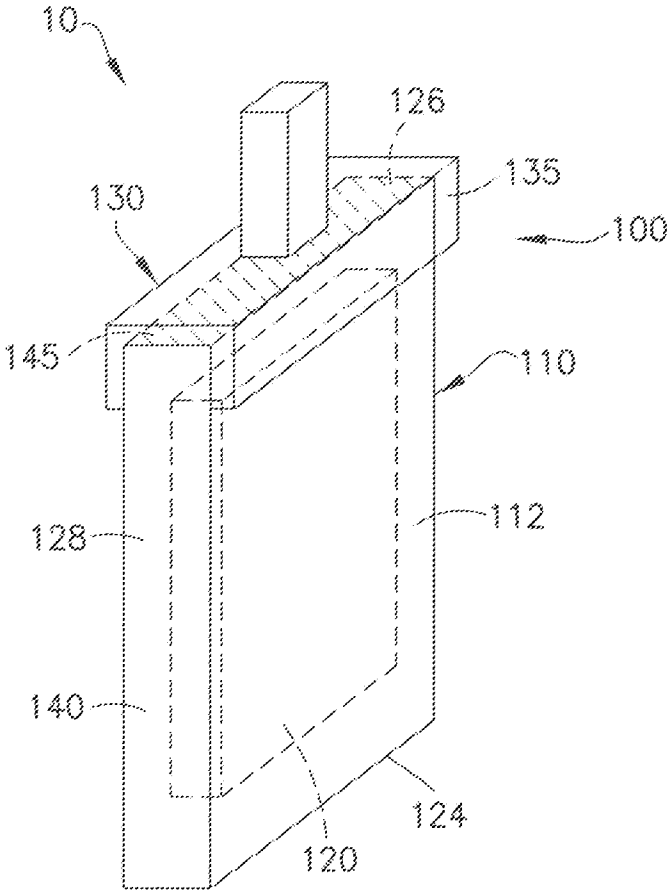
FIG. 2 illustrates an electrolytic cell anode assembly according to an embodiment of the present invention.

The drawings above are not necessarily to scale, with emphasis instead generally being placed upon illustrating the principles of the present invention. Further, some features may be exaggerated to show details of particular components. These drawings/figures are intended to be explanatory and not restrictive of the invention.

DETAILED DESCRIPTION OF THE EMBODIMENTS

Reference will now be made in detail to the various embodiments of the present invention. The embodiments are described below to provide a more complete understanding of the components, processes, and apparatuses of the present invention. Any examples given are intended to be illustrative, and not restrictive. Throughout the specification and claims, the following terms take the meanings explicitly associated herein, unless the context clearly dictates otherwise. The phrases "in some embodiments" and "in an embodiment" as used herein do not necessarily refer to the same embodiment(s), though they may. Furthermore, the phrases "in another embodiment" and "in some other embodiments" as used herein do not necessarily refer to a different embodiment, although they may. As described below, various embodiments of the present invention may be readily combined, without departing from the scope or spirit of the present invention.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, dense conductive material refers to a conductive, relatively non-porous material.

As used herein, dimensionally stable refers to the electrode maintaining relatively stable and/or uniform wear along its dimensions.

As used herein, sintering refers to the process of densifying a material (e.g. metal particles) by heating.

As used herein, substantially non-consumable refers to the inert nature of the electrode when compared to a conventional carbon anode that is consumed in weeks in an electrolysis cell at operating conditions. The rate of consumption is very slow when compared to a carbon anode.

All physical properties that are defined hereinafter are measured at 20° to 25° Celsius unless otherwise specified.

When referring to any numerical range of values herein, such ranges are understood to include each and every number and/or fraction between the stated range minimum and maximum. For example, a range of about 0.5-6% would expressly include all intermediate values of about 0.6%, 0.7%, and 0.9%, all the way up to and including 5.95%, 5.97%, and 5.99%. The same applies to each other numerical property and/or elemental range set forth herein, unless the context clearly dictates otherwise.

Generally, a metallic pin or rod is used to provide an electrical current to an anode in an electrolytic cell. The metallic rod or pin may be inserted within the anode, and may be disposed through most of the length of the anode. The metallic rod or pin provides a highly electrically conductive path within the anode and distributes a current throughout the anode. However, when used with non-cylindrical anodes, the geometry of the metallic rod or pin becomes complex, making it difficult to manage differential thermal stresses generated in the anode, potentially resulting in the cracking of the anode and/or one or more of its components. Furthermore, areas of interface between the metallic rod or pin and the anode are subject to increased erosion or wear due to exposure to chemical off-gases and reactants.

Figure 1:
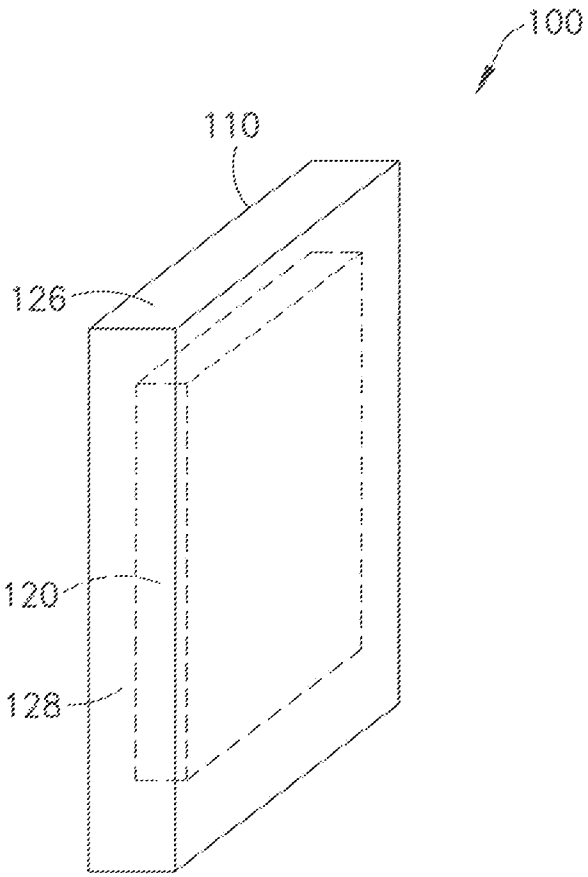
FIG. 1 illustrates an electrolytic cell anode according to an embodiment of the present invention.

FIG. 1 illustrates an electrolytic cell anode according to an embodiment of the present invention. As illustrated in FIG. 1, an electrolytic cell anode (100) may include a dense conductive material (120) and an encasing conductive material (110). In some embodiments, the encasing conductive material (110) is configured to encase the dense conductive material (120) and define the electrolytic cell anode (100).

In order to achieve a low voltage drop within the electrolytic cell anode (100), in some embodiments of the present invention, the dense conductive material (120) has a relatively higher electrical conductivity than the encasing conductive material (110). In one embodiment, the current path through the electrolytic cell anode (100) is determined by the relative electrical conductivity of the dense conductive material to the encasing conductive material. In one embodiment, the dense conductive material (120) provides a highly electrically conductive path to distribute a current throughout the electrolytic cell anode (100) with minimal voltage drop.

In some embodiments, when the electrolytic cell anode (100) is part of an anode assembly (10), the increased electrical conductivity of the dense conductive material (120) allows a lower voltage drop across the various material boundaries of the anode assembly (10) which facilitate efficient production of metal. For example, a lower voltage drop from the electrical source through at least one of the bottom and/or side surfaces of the electrolytic cell anode (110) helps lower the total energy usage of the anode assembly (10). In some embodiments, the voltage drop obtained can be measured and/or indirectly inferred from the total voltage and various component voltages of the anode assembly (10).

In one embodiment of the present invention, the dense conductive material (120) has an electrical conductivity at least 2 times larger than that of the encasing material (110). In another embodiment, the electrical conductivity of the dense conductive material (120) is at least 5 times larger than that of the encasing material (110). In another embodiment, the electrical conductivity of the dense conductive material (120) is at least 10 times larger than that of the encasing material (110). For example, in one embodiment, the encasing material (110) has an electrical conductivity of between about 150 S/cm and 250 S/cm and the dense conductive material (120) has an electrical conductivity of between about 300 S/cm and 500 S/cm. In another embodiment, the encasing material (110) has an electrical conductivity of between about 150 S/cm and 250 S/cm and the dense conductive material (120) has an electrical conductivity of between about 750 S/cm and 1250 S/cm. In another embodiment, the encasing material (110) has an electrical conductivity of between about 150 S/cm and 250 S/cm and the dense conductive material (120) has an electrical conductivity of between about 1500 S/cm and 2500 S/cm.

In one embodiment, the encasing material (110) has an electrical conductivity of between about 180 S/cm and 200 S/cm and the electrical conductivity of the dense conductive material (120) is at least 360 S/cm. In another embodiment, the encasing material (110) has an electrical conductivity of between about 180 S/cm and 200 S/cm and the electrical conductivity of the dense conductive material (120) is at least 900 S/cm. In another embodiment, the encasing material (110) has an electrical conductivity of between about 180 S/cm and 200 S/cm and the electrical conductivity of the dense conductive material (120) is at least 1800 S/cm.

In an embodiment of the present invention, the electrolytic cell anode (100) is embodied as an inert electrolytic cell anode (100). For example, the inert electrolytic cell anode (100) may be substantially non-consumable and/or dimensionally stable in an electrolytic molten salt bath and/or during metal production conditions. In one embodiment, the inert electrolytic cell anode (100) lasts at least 100 times longer than a conventional carbon anode under metal production conditions. In another embodiment, a rate of anode consumption for an inert anode is slower when compared to a carbon anode. In another embodiment, the inert electrolytic cell anode (100) has an operation life within a molten electrolytic bath under metal production conditions rate of at least 12 months. In contrast, conventional carbon anodes have a high consumption rate (up to 1-2 cm per day) and an operational life measured in weeks, In embodiments of the present invention, the electrolytic cell may be configured for the production of aluminum metal, and the electrolytic bath may include a molten cryolite electrolyte bath. In one embodiment, the inert electrolytic cell anode (100) remains substantially non-consumable and dimensionally stable in a molten cryolite bath of an aluminum electrolytic cell operating at a temperature of between about 750° C. and 900° C. In another embodiment, the inert electrolytic cell anode (100) remains substantially non-consumable and dimensionally stable in a molten cryolite bath of an aluminum electrolytic cell operating at a temperature of at least about 750° C. In another embodiment, the inert electrolytic cell anode (100) remains substantially non-consumable and dimensionally stable in a molten cryolite bath of an aluminum electrolytic cell operating at a temperature of at most 900° C.

In other embodiments, the inert electrolytic cell anode (100) is configured for use within an electrolytic aluminum production cell, and the inert electrolytic cell anode (100) remains substantially stable in a molten electrolytic bath operating at a temperature of at least about 775° C., at least about 800° C., at least about 825° C., at least about 850° C., at least about 875° C.

In other embodiments, the inert electrolytic cell anode (100) remains substantially stable in a molten electrolytic cell bath operating at a temperature not greater than about 775° C., not greater than about 800° C., not greater than about 825° C., not greater than about 850° C., not greater than about 875° C., not greater than about 900° C., not greater than about 925° C., not greater than about 950° C., and not greater than about 975° C.

While the electrolytic cell anode (100) is described above in terms of an aluminum electrolytic cell, the present invention is not limited thereto. In other embodiments of the invention, the electrolytic cell anode (100) may be used in electrolytic cells configured to produce other metals.

In one embodiment of the present invention, the electrolytic cell anode (100) may include a cermet material and/or a ceramic material. In other embodiments, the electrolytic cell anode (100) includes a metal oxide. In some embodiments, the cermet or ceramic electrolytic cell anode functions as a substantially inert electrolytic cell anode (100).

In another embodiment, the inert electrolytic cell anode (100) may include an outer coating or casing of a cermet material encasing a central core. For example, as illustrated in FIG. 1, an electrolytic cell anode (100) embodied as an inert electrolytic cell anode (100) may include a central core of a dense conductive material (120) encased by an outer coating of a cermet material as an encasing conductive material (110).

In one embodiment, the outer coating may have a thickness of about between 0.1 mm to 50 mm, between 1 mm to 10, and/or between 1 mm and 20 mm.

In another embodiment, the encasing conductive material (110) includes at least one of a cermet material, a ceramic material, a metal oxide, and combinations thereof. For example, in one embodiment, the encasing conductive material (110) includes a metal oxide. In some embodiments, the metal oxide is one of iron (Fe) oxides, nickel (Ni) oxides, zinc (Zn) oxides, copper (Cu) oxides, tin (Sn) oxides, and combinations thereof. In one embodiment of the present invention, the encasing conductive material (110) includes at least one of $Fe_3O_4$, $Fe_2O_3$, FeO, and combinations thereof. In another embodiment, the encasing conductive material (110) consists essentially of one of $Fe_3O_4$, $Fe_2O_3$, FeO, combinations thereof, and other impurities or elements that do not materially affect the basic characteristic(s) of the invention.

In another embodiment, the encasing conductive material (110) includes a ceramic material, and the ceramic material may include oxides of nickel (Ni) or iron (Fe). In another embodiment, the ceramic material includes at least one metal. In another embodiment, the metal is at least one of Zn, cobalt (Co), aluminum (Al), lithium (Li), Cu, (titanium) Ti, vanadium (V), chromium (Cr), zirconium (Zr), niobium (Nb), tantalum (Ta), tungsten (W), molybdenum (Mo), and hafnium Hf. In another embodiment, the ceramic material includes rare earths.

In another embodiment, the encasing conductive material (110) includes a cermet material, and the metal phase of the cermet material may include at least one of Cu, Ag, lead (Pd), platinum (Pt), gold (Au), rhodium (Rh), ruthenium (Ru), iridium (Ir), and osmium (Os).

To achieve a lower voltage drop in the electrolytic cell anode (100), in embodiments of the present invention, the dense conductive material (120) has a higher electrical conductivity than the encasing conductive material (110).

For example, in one embodiment of the present invention, the dense conductive material (120) may include an electrically conductive metal, such as copper. In some embodiments, the conductive metal may include zinc, iron, copper, silver, nickel, gold, chromium, cobalt, manganese, silicon, molybdenum, tungsten, platinum, compounds thereof, alloys thereof, combinations thereof, and the like.

In some embodiments, the dense conductive material (120) may include metal oxides or metal ferrites of the electrically conductive metal. For example, the dense conductive material (120) may include iron ferrite, nickel ferrite, zinc ferrite, or copper ferrite, to name a few. In some embodiment, the dense conductive material (120) may include combinations of the electrically conductive metal and metal oxides or metal ferrites. For example, the dense conductive material (120) may include copper mixed with copper oxide and/or copper ferrite, copper mixed with Fe3O4, copper mixed with Fe3O4, and at least one of Fe2O3 and FeO.

In some embodiments, the dense conductive material (120) may include at least one of a metal plate, a powdered metal, a cermet material, a metal wire, chopped wire, metal particulates, and a metal matte. In one embodiment, the dense conductive material (120) is embodied as copper mixed with $Fe_3O_4$ and at least one additive. In another embodiment, the at least one additive is at least one of $Fe_2O_3$ and FeO.

In some embodiments, the metal particulate or metal powder is embodied as fine, loose particulate solid. In other embodiments, the powdered metal may be in a compacted, preformed powder. In another embodiment, a cermet material may include a conductive ceramic, e.g., magnetite ($Fe_3O_4$), and copper as a compact, preformed powder.

In some embodiments, the metal plate or metal wires within the dense conductive material (120) may be arranged to facilitate an efficient current flow through the electrolytic cell anode (100). For example, a metal plate or metal wire may be located in the direction of current flow, e.g., from a top portion of the inert electrolytic cell anode (100) to a bottom portion of the electrolytic cell anode (100).

In one embodiment, the dense conductive material (120) includes at least one of a cermet material, a ceramic material, a metal oxide, and combinations thereof, having a higher electrical conductivity than the encasing conductive material (110). In some embodiments, the metal oxide is one of iron (Fe) oxides, nickel (Ni) oxides, zinc (Zn) oxides, copper (Cu) oxides, tin (Sn) oxides, and combinations thereof. In some embodiments, the dense conductive material (120) includes at least one of $Fe_3O_4$, $Fe_2O_3$, FeO, and combinations thereof. In another embodiment, the dense conductive material (120) consists essentially of one of $Fe_3O_4$, $Fe_2O_3$, FeO, combinations thereof, and other impurities or elements that do not materially affect the basic characteristic(s) of the invention.

In some embodiments of the present invention, the dense conductive material (120) is based on the same material as the encasing conductive material (110) but modified to increase an electrical conductivity of the dense conductive material (120).

For example, in some embodiments, the composition or content of metal oxides between the encasing conductive material (110) and the dense conductive material (120) is adjusted such that the dense conductive material (120) has a higher electrical conductivity than the encasing conductive material (110).

In another embodiment, the dense conductive material includes copper mixed with at least one of $Fe_3O_4$, at least one $Fe_3O_4$, $Fe_2O_3$, FeO.

In another embodiment, the encasing conductive material (110) and the dense conductive material (120) include the same base composition, and the dense conductive material further includes additional conductive materials to increase an electrical conductivity of the dense conductive material (120). For example, in one embodiment, both the encasing conductive material (110) and the dense conductive material (120) are made of the same cermet material, but the dense conductive material (120) further includes an effective amount of metallic particulates, such as copper powders or particles, to increase an electrical conductivity thereof.

In one embodiment of the present invention, both the encasing conductive material (110) and the dense conductive material (120) include metal oxides and/or metal ferrites, but the dense conductive material (120) further includes at least between 3% and 35% of an additional metal particulate mixed with metal oxides and/or metal ferrites. In another embodiment the dense conductive material (120) includes at least between 10% and 35% metal particulate mixed with the metal oxides and/or metal ferrites. In another embodiment the dense conductive material (120) includes at least between 15% and 30% metal particulate mixed with the metal oxides and/or metal ferrites. In another embodiment the dense conductive material (120) includes at least between 20% and 30% metal particulate mixed with the metal oxides and/or metal ferrites.

In another embodiment, the dense conductive material (120) includes at least 5% metal particulate mixed with metal oxides and/or metal ferrites. In another embodiment, the dense conductive material (120) includes at least 10% metal particulate mixed with metal oxides and/or metal ferrites. In another embodiment, the dense conductive material (120)

includes at least 15% metal particulate mixed with metal oxides and/or metal ferrites. In another embodiment, the dense conductive material (120) includes at least 25% metal particulate mixed with metal oxides and/or metal ferrites.

In some embodiments of the present invention, the encasing conductive material (110) and the dense conductive material (120) are casted into a monolithic electrolytic cell anode (100). For example, as described in Examples 1 and 2 below, the encasing conductive material (110) and the dense conductive material (120) may be casted from a same ceramic base material into a monolithic electrolytic cell anode (100), wherein the region of electrolytic cell anode (100) corresponding to the dense conductive material (120) has a higher electrical conductivity.

In some embodiments of the present invention, the dense conductive material (120) is completely encased within the encasing conductive material (110) to prevent contamination of the molten salt bath or electrolyte during metal production. For example, in embodiments where the dense conductive material (120) includes metal materials to increase an electrical conductivity thereof, the dense conductive material (120) is completely encased within the encasing conductive material (110), such that all sides and/or surfaces of the electrolytic cell anode (100) are covered by the encasing conductive material (120). In other embodiment, portion of the electrolytic cell anode (100) exposed to the molten electrolytic bath are covered by the encasing conductive material (120). For example, as illustrated in FIG. 1, in one embodiment the dense conductive material (120) is completely encased within the encasing conductive material (110).

In some embodiments, the encasing conductive material (120) remains substantially non-consumable and dimensionally stable in a molten cryolite bath of an aluminum electrolytic cell operating at a temperature of between about 750° C. and 900° C.

In one embodiment of the present invention, the dense conductive material (120) comprises between about 10% and 50% of the electrolytic cell anode (100).

In some embodiments, if the volume of the electrolytic cell anode (100) comprised by the dense conductive material (120) is less than 10%, the beneficial voltage drop effects due to the higher electric conductivity of the dense conductive material may be reduced. In other embodiments, if the volume portion of the dense conductive material (120) is more than 50%, the portion of encasement conductive material may be too low. In such embodiments, there is an increased risk that the molten electrolytic bath may erode the encasement conductive material (110) sooner, and expose the dense conductive material (120) to the molten electrolytic bath during the expected operation life of the electrolytic cell anode (100), contaminating the molten electrolytic bath with the constituents of the dense conductive material (120).

In some embodiments, the volumetric ratio (e.g. the ratio of dense conductive material (120) to encasing conductive material (110) is between about 1:10 and 1:2.

In other embodiments, the volumetric ratio is at least about 1:8. In another embodiment, the volumetric ratio is at least about 1:6. In another embodiment, the volumetric ratio is at least about 1:4.

As illustrated in FIG. 2, in some embodiments of the present invention, the electrolytic cell anode (100) is part of an anode assembly (10) and further includes an electrical connector (130) configured to provide an electrical current to the electrolytic cell anode (100). For example, in some embodiments, the electrical connector (130) is configured to electrically connect the electrolytic cell anode (100) to an electrical source (not illustrated). In one embodiment, the electrical connector (130) is electrically coupled to a surface of the electrolytic cell anode (100).

Figure 4:
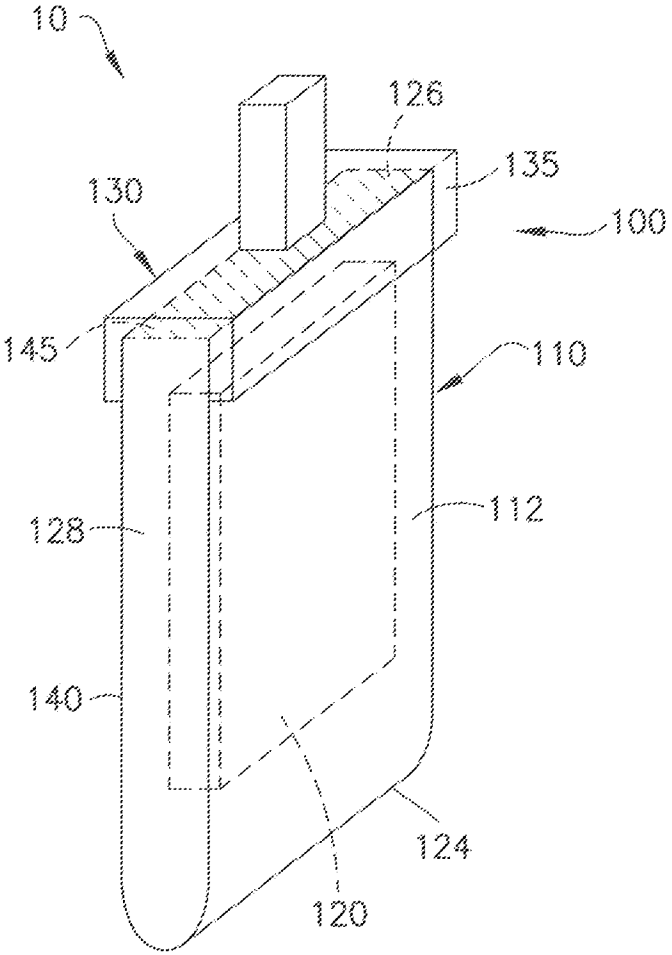
FIG. 4 illustrates an embodiment of an electrolytic cell anode according to the present invention.
Figure 3:
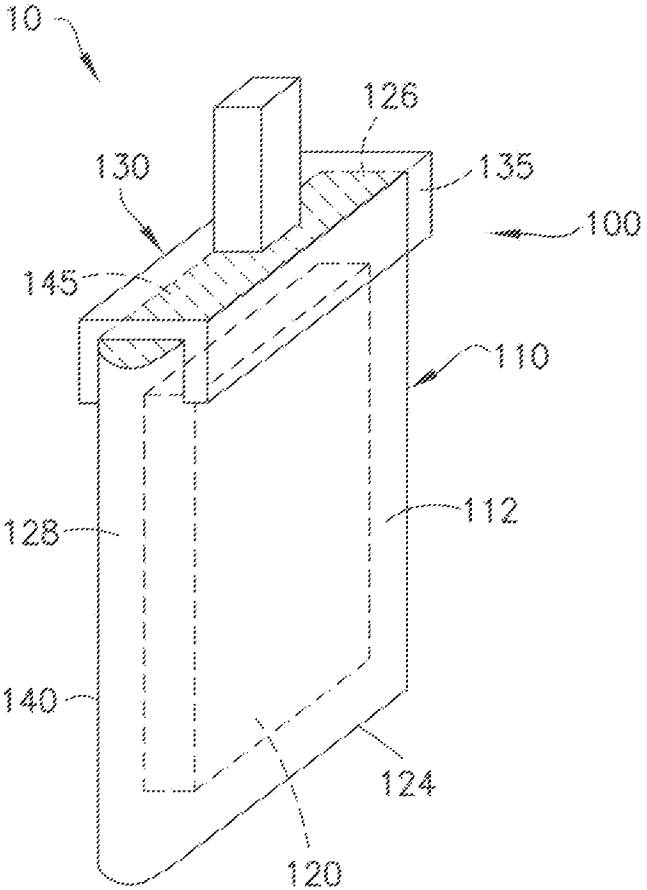
FIG. 3 illustrates an embodiment of an electrolytic cell anode according to the present invention.

In one example, as illustrated in FIG. 2, the electrolytic cell anode (100) is plate-shaped, and includes a top surface (126), a bottom surface (124), side surfaces (128), and front and back faces (112). While embodiments of the present invention illustrated in FIGS. 1-2 are plate-shaped, that is, with parallel sides and faces, the present invention is not limited thereto, and the electrolytic cell anode (100) may have other shapes, such as cylindrical, square, tubular, etc. For example, as illustrated in FIGS. 3-4, one or more of the side surfaces (128), the top surface (126), and the bottom surface (124) may be rounded.

In one embodiment, the electrical connector (130) is electrically coupled to an outer surface (140) of the electrolytic cell anode (100). As illustrated in FIG. 2, in one embodiment, the electrical connector (130) couples to an area of the outer surface (140) including upper portions of the top surface (126) and upper portions of the front and back faces (112).

Figure 5:
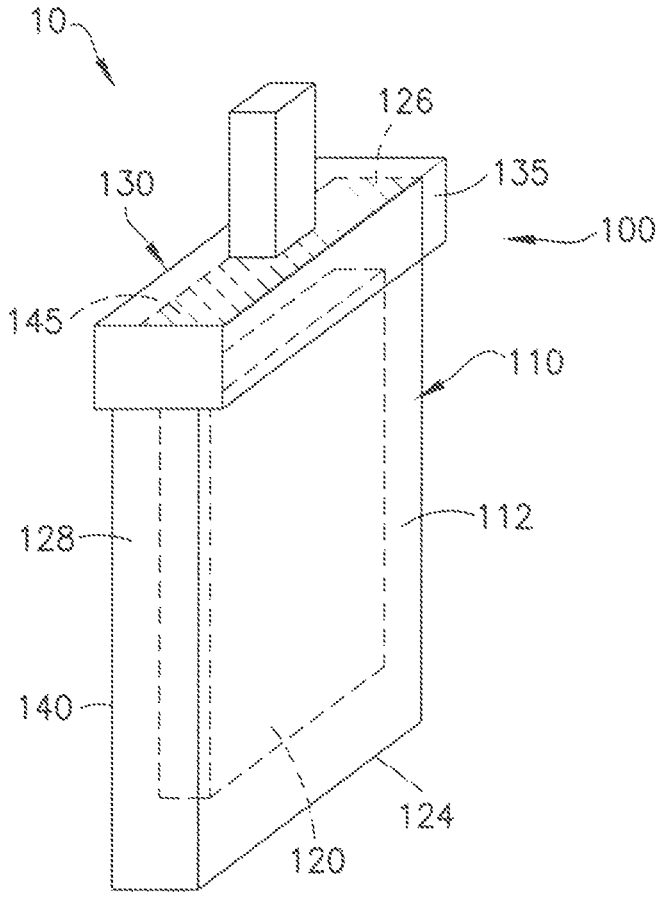
FIG. 5 illustrates an embodiment of an electrolytic cell anode according to the present invention.

In another embodiment, the electrical connector (130) couples to the top of the electrolytic cell anode (100). For example, as illustrated in FIG. 5, in one embodiment, the electrical connector (130) couples to the top surface (126), upper portions of the front and back faces (112), and upper portions of the side surfaces (128).

In some embodiments, at least one of the top surface (126), bottom surface (124), side surfaces (128), and faces (112) of the electrolytic cell anode (100) is defined by the encasing conductive material (110), and the electrical connector (130) is electrically coupled to the encasing conductive material (110). In one embodiment, the electrical connector (130) directly contacts the encasing conductive material (110). In other embodiments, the electrical connector (130) does not directly contact the dense conductive material (120). In one embodiment, the electrolytic cell anode (100) does not include an electrical pin inserted into its body. For example, in some embodiments, an electrical pin does not enter into either the encasing conductive material (110) or the dense conductive material (120).

In one embodiment of the present invention, the electrical connector (130) may be a metallic device. For example, the electrical connector (130) may be any metal suitable to facilitate an electrical connection between the electrolytic cell anode (100) and an electrical source. In one embodiment, the electrical connector (130) may be a clamping device. For example, the electrical connector (130) may be any device capable of fastening to the electrolytic cell anode (100) to provide an electrical current, such as a metallic clamping device.

As illustrated in FIG. 2, in some embodiments the anode assembly (10) includes an electrical connection material (145) to facilitate an electrical contact between the electrical connector (130) and the electrolytic cell anode (100).

For example, in some embodiments, the electrical connection material (145) may include at least one of a metallic paint, a metallic foam, metallic shot, or combinations thereof.

In other embodiments, the electrical connection material (145) may be embodied as an electrical connection paint or paste, such as a metallic paint or metallic foam. For example, in some embodiments, the metallic paint is an electrically conductive metallic paint, such as a copper paint, disposed on an outer surface (140) of the electrolytic cell anode (100). In another embodiment, a copper paint (145) may be disposed on an outer surface (135) of the electrical connector (130).

EXAMPLE 1

In one example of the present invention, an inert electrolytic cell anode may be prepared by preparing two ready-to-press ceramic powders as follows:

A mixture of ingredients to form an inert ceramic anode can be ground to a fine particle size using a ball mill. The fine particle mixture can then be blended with water and a polymeric binder and/or plasticizer to create a ceramic slurry. Examples of suitable binders include polyvinyl alcohol, acrylic polymers, polyglycols, polyvinyl acetate, polyisobutylene, polycarbonates, polystyrene, polyacrylates, and mixtures, and copolymers thereof. The ceramic slurry can then be sprayed dried to produce a first ready-to-press ceramic powder.

Similarly, a second ready-to-press ceramic powder can be created using the same steps as described above. However, in order to increase an electrical conductivity of the second ready-to-press ceramic powder, the mixture of ingredients to form an inert ceramic anode can be modified to include a mixture of metal oxides, such as iron oxides.

An electrolytic cell anode (100) can then be created by pressing and/or sintering the first and second ready-to-press powders. For example, in one embodiment, the first and second ready-to-press powders may be layered into a mold such that an inner central portion is formed of the (higher electrically conductive) second ready-to-press powder, completely encased within an outer body formed of the first ready-to-press powder.

The mold can then be pressed and/or sintered to create a ceramic electrolytic cell anode (100) embodied as a central core of a dense conductive material (120) encased by an outer coating of a encasing conductive material (110).

In one embodiment, the mold can be uniaxially pressed at 5,000 to 40,000 psi to create a generally planar ceramic anode green-pressed shape having a higher electrically conductive center region. In another example, the pressure used may be of about 30,000 psi for many other final applications.

The green-pressed shapes may then be sintered at temperatures of about 500 C-1,600° C. to create the electrolytic cell anode (100). For example, the green-pressed bodies may be sintered in a furnace at about between 1,250° C. and 1,350° C. for about 0.5 hrs to 20 hrs,

EXAMPLE 2

In another example, an inert electrolytic cell anode may be prepared using a pre-pressed green body formed of a highly conductive two ready-to-press ceramic powders as follows:

As above, a mixture of ingredients to form an inert ceramic anode can be ground to a fine particle size using a ball mill The mixture of ingredients includes a mixture of metal oxides, metal particulates, metal ferrites, or the like, to increase an electrical conductivity thereof.

The fine particle mixture can then be blended with water and a polymeric binder and/or plasticizer to create a ceramic slurry, and the ceramic slurry can then be sprayed dried to create a ready-to-press ceramic powder.

The ready-to-press ceramic powder is then inserted into a mold and pressed to create a ceramic green pressed form.

The ceramic green pressed form can then be inserted into a second mold and layered with a less electrically conductive ready-to-press ceramic powder, layered such that the green pressed form is completely surrounded by the less electrically conductive ready-to-press ceramic powder. The second mold can then be pressed and sintered to create a ceramic electrolytic cell anode (100) embodied as a central core of a dense conductive material (120) encased by an outer coating of a encasing conductive material (110).

EXAMPLE 3

In another example, an inert electrolytic cell anode may be prepared using two pre-pressed green bodies formed of ready-to-press ceramic powders with different electrical conductivities as follows:

Using the same general preparation as referenced above, it is also possible to utilize a pre-pressed and/or pre-pressed and pre-sintered central inner portion (e.g. formed of the more electrically conductive ready-to-press ceramic powder) and pre-pressed or pre-pressed and pre-sintered outer body portion (formed of the less electrically conductive ready-to-press ceramic powder and including a top, bottom, sides, and/or faces of the anode), where the pre-pressed components are assembled together and then subjected to a final press and/or sintering process are completed to create a ceramic electrolytic cell anode (100) embodied as a central core of a dense conductive material (120) encased by an outer coating of a encasing conductive material (110). In some embodiments, the pre-pressing and/or pre-pressing and pre-sintering of the ready to press-powders involved only partially pre-pressing and/or pre-pressing and pre-sintering the ready to press-powders.

Figure 6:
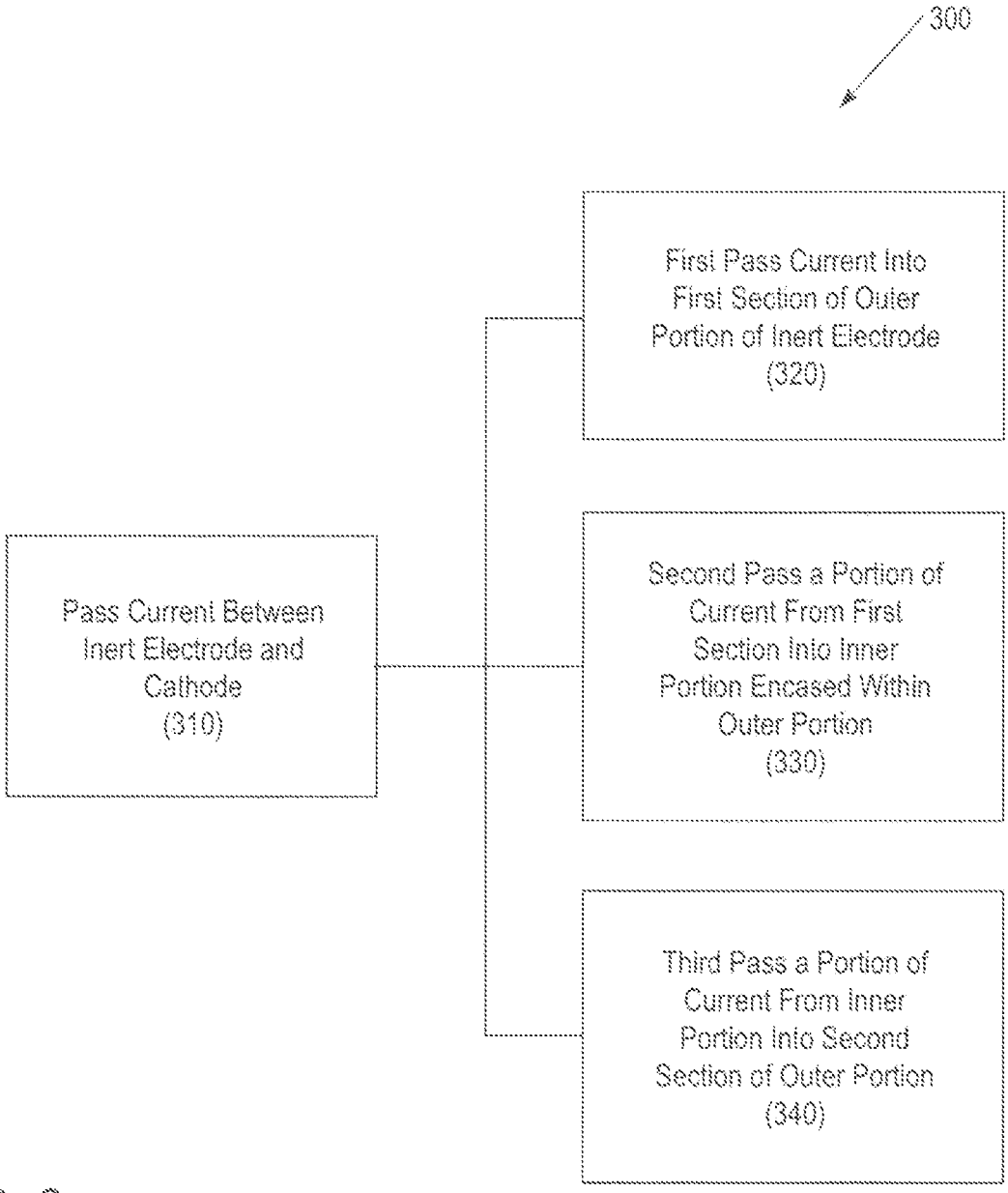
FIG. 6 illustrates a method of using an electrolytic cell anode according to an embodiment of the present invention.
Figure 7:
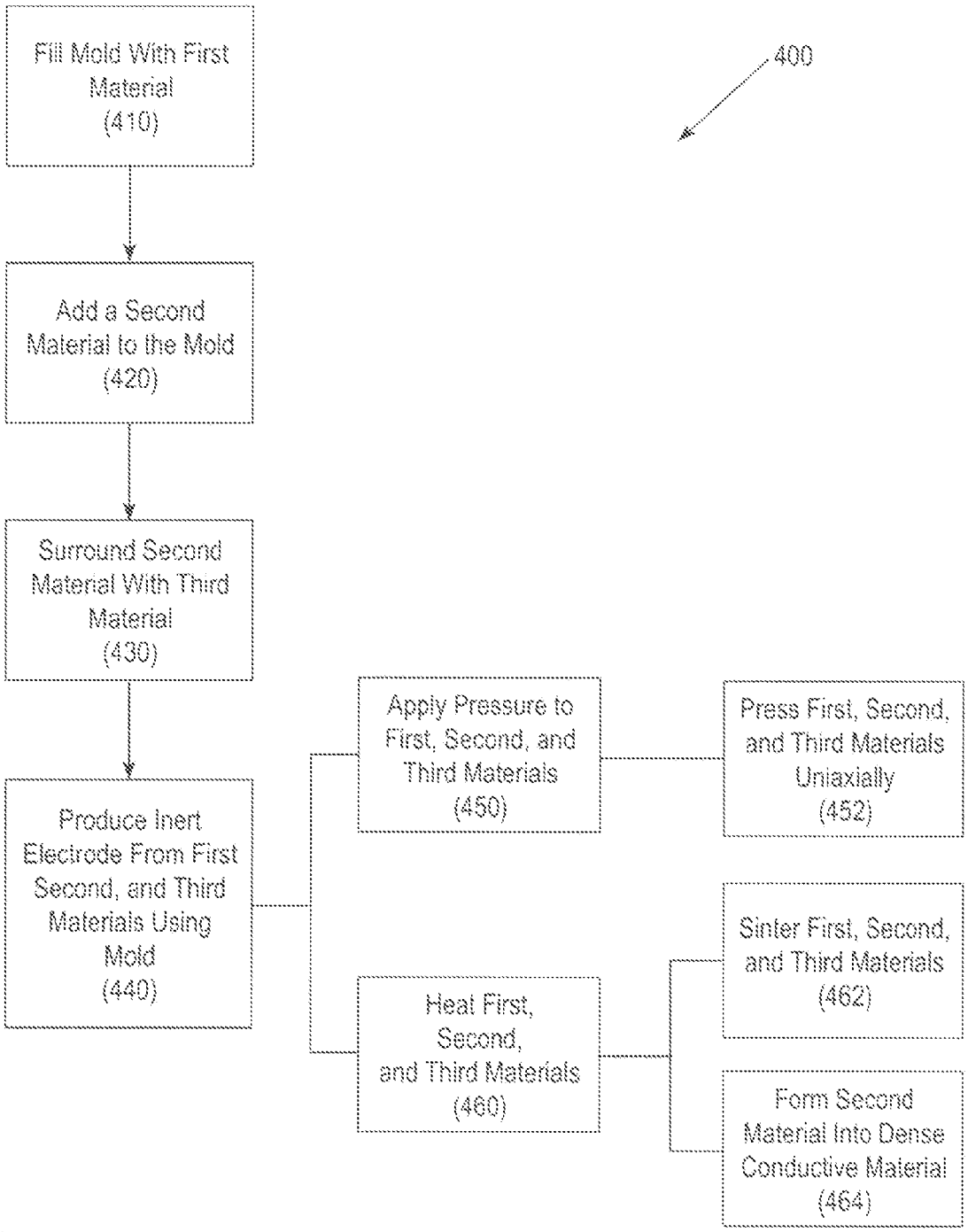
FIG. 7 illustrates another embodiment of a method of using an electrolytic cell anode according to the present invention.

FIGS. 6 and 7 illustrate methods of using and making an electrolytic cell anode according to embodiments of the present invention to produce metals, such as aluminum. In one embodiment, a method of using an electrolytic cell anode (100) may include passing an electrical current between the electrolytic cell anode (100) and a cathode of an electrolytic reaction cell. For example, as illustrate in FIGS. 6-7, a method may include first, passing the electrical current from the electrical connector through a first section of the encasing conductive material of the electrolytic cell anode; wherein the first section is proximal to the electrical connector; second, passing a portion of the current from the first section of the outer portion of the inert electrode into the dense conductive material encased within the electrolytic cell anode; and third, passing a portion of the current from the dense conductive material through to a second section of the encasing conductive material, wherein the second section is proximal to the cathode of the electrolytic bath. In some embodiments, while current passes throughout the anode, a majority of the current passes through the dense conductive material (120) to balance the electrical load.

In one embodiment, as illustrated in FIG. 6, a method (300) includes passing an electrical current between an inert electrode and a cathode (310), wherein the passing step (310) include first passing current into a first section of an outer portion of the inert electrode (320), second passing a portion of the current from the first section of the outer portion of the inert electrode into an inner portion encased within the outer portion of the inert electrode (330), and third passing a portion of the current from the inner portion encased within the outer portion of the inert electrode into a second section of the outer portion of the inert electrode (340).

In another embodiment, and with reference now to FIG. 7, a method for producing an anode assembly (10) is provided. As illustrated in FIG. 7, a method (400) includes filling a portion of a mold with a first material (410), adding a second material to the mold (420), surrounding at least a portion of the second material with a third material (430), and producing an electrolytic cell anode (100) from the first and third materials defining an encasing conductive material (110) and a second material defining a dense conductive material (120) using the mold (440).

In some embodiments, the producing step (440) includes applying a pressure to the first, second, and third materials (450), and heating the first, second, and third materials (460). In some embodiments, the applying step (450) includes the step of pressing the first, second, and third materials uniaxially (452).

In some embodiments, the heating step (460) includes forming the second material into a dense conductive material (120) (464). In some embodiments, the heating step (460) optionally includes sintering the first, second, and third materials (462).

Although a few embodiments of the present invention have been shown and described, it will be appreciated by those skilled in the art that changes may be made in these embodiments without departing from the principles and spirit of the present invention, the scope of which is defined in the appended claims and their equivalents.

What is claimed is:

1. An electrolytic cell anode, comprising:

a dense conductive material; and an encasing conductive material configured to encase the dense conductive material and define the electrolytic cell anode, wherein the dense conductive material has an electrical conductivity greater than that of the encasing conductive material;

an electrical connector configured to pass an electrical current into the dense conductive material via the encasing conductive material;

wherein the electrical connector does not directly contact the dense conductive material of the electrolytic cell anode;

wherein the electrical connector couples to the encasing material of the electrolytic cell anode, and wherein the encasing material is configured to encased the dense conductive material of the electrolytic cell anode such that the electrical connector does not directly contact the dense conductive material.

2. The electrolytic cell anode of claim 1, wherein the dense conductive material has an electrical conductivity of at least about 1000 S/cm.

3. The electrolytic cell anode of claim 1, wherein the encasing conductive material has an electrical conductivity of between about 150 S/cm and 200 S/cm.

4. The electrolytic cell anode of claim 1, wherein the dense conductive material has an electrical conductivity at least 5 times higher than the encasing material.

5. The electrolytic cell anode of claim 1, wherein the encasing conductive material comprises a metal oxide.

6. The electrolytic cell anode of claim 5, wherein the encasing conductive material comprises at least one of an iron oxide, nickel oxide, zinc oxide, copper oxide, tin oxide, and combinations thereof.

7. The electrolytic cell anode of claim 1, wherein the encasing conductive material further comprises an iron oxide.

8. The electrolytic cell anode of claim 1, wherein the encasing conductive material comprises at least one of Fe3O4, Fe203, and FeO.

9. The electrolytic cell anode of claim 1, wherein the dense conductive material comprises a metal oxide.

10. The electrolytic cell anode of claim 1, wherein the dense conductive material further comprises a metal.

11. The electrolytic cell anode of claim 1, wherein the dense conductive material comprises a metal oxide portion and a metallic portion.

12. The electrolytic cell anode of claim 11, wherein the metallic portion comprises metal particles within the metal oxide.

13. The electrolytic cell anode of claim 11, wherein the metallic portion gives the dense conductive material a higher electrical conductivity than the encasing conductive material when the dense conductive material and the encasing conductive material comprise the same metal oxide.

14. The electrolytic cell anode of claim 1, wherein the dense conductive material comprises the same metal oxide as the encasing material.

15. The electrolytic cell anode of claim 1, wherein the dense conductive material comprises at least one of Fe3O4, Fe203, and FeO.

16. The electrolytic cell anode of claim 1, wherein the dense conductive material comprises copper.

17. The electrolytic cell anode of claim 1, wherein the dense conductive material and the encasing conductive material are integrally formed into the electrolytic cell anode.

18. The electrolytic cell anode of claim 1, wherein. the electrolytic cell anode is substantially non-consumable and dimensionally stable.

19. The electrolytic cell anode of claim 1, wherein the electrolytic cell anode is substantially an inert anode.

20. The electrolytic cell anode of claim 1, wherein the electrolytic cell anode is configured to remain stable in a molten bath of an aluminum electrolytic cell at a temperature of at least about 750° C.

21. The electrolytic cell anode of claim 1, wherein the electrolytic cell anode is configured to remain substantially non-consumable and dimensionally stable in a molten bath of an aluminum electrolytic cell at a temperature of at least about 750° C.

22. The electrolytic cell anode of claim 1, wherein the electrolytic cell anode is configured to stable in a molten bath of an aluminum electrolytic cell at a temperature of at most about 900° C.

23. The electrolytic, cell anode of claim 1, wherein the electrolytic cell anode is configured to remain substantially non-consumable and dimensionally stable in a molten bath of an aluminum electrolytic cell at a temperature of between about 750° C. and 90020 C.

24. The electrolytic cell anode of claim 1, wherein the dense conductive material comprises between about 10 % and 50 % of the electrolytic cell anode.

25. The anode assembly of claim 1, further comprising an electrical contacting material to facilitate the electrical connection between the electrical contact and the electrolytic cell anode.

26. The anode assembly of claim 25, wherein the electrical contacting material comprises a metal.

27. The anode assembly of claim 25, wherein the electrical contacting material comprises at least one of a metal paint, a metal foam, metal shot, and combinations thereof.

28. The anode assembly of claim 1, wherein the anode assembly is configured for electrolytic aluminum production.

29. A method comprising:

passing an electrical current between an anode and a cathode of an electrolytic reaction cell, wherein the anode comprises the anode assembly of claim 1.

30. The method of claim 29, wherein the passing of the electrical current comprises:

(i)first passing the electrical current from the electrical connector through a first section of the encasing conductive material of the electrolytic cell anode; wherein the first section is proximal to the electrical connector;

(ii)second passing a portion of the current from the first section of the outer portion of the inert electrode into the dense conductive material encased within the electrolytic cell anode; and (iii)third passing a portion of the current from the dense conductive material through to a second section of the encasing conductive material, wherein the second section is proximal to the cathode of the electrolytic bath.

31. The method of claim 29, wherein while the current passes throughout the electrolytic cell anode, a majority of the current passes through the dense conductive material as the electrical current load is balanced.

* * * * *

UNITED STATES PATENT AND TRADEMARK OFFICE

CERTIFICATE OF CORRECTION

PATENT NO. : 9,222,183 B2
APPLICATION NO. : 13/954019
DATED : December 29, 2015
INVENTOR(S) : D'Astolfo, Jr.

It is certified that error appears in the above-identified patent and that said Letters Patent is hereby corrected as shown below:

In the Claims

Column 14, line 41, delete "90020 C." and insert -- 900° C. --

Signed and Sealed this
Twenty-sixth Day of July, 2016

Michelle K. Lee

Michelle K. Lee
*Director of the United States Patent and Trademark Office*